US011491534B2

(12) United States Patent
Nagai et al.

(10) Patent No.: US 11,491,534 B2
(45) Date of Patent: Nov. 8, 2022

(54) CONTINUOUS CASTING METHOD, CAST SLAB, AND CONTINUOUS CASTING APPARATUS

(71) Applicant: NIPPON STEEL CORPORATION, Tokyo (JP)

(72) Inventors: Shinji Nagai, Tokyo (JP); Toshiaki Mizoguchi, Tokyo (JP); Kenji Kubo, Tokyo (JP); Makoto Ishii, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 186 days.

(21) Appl. No.: 16/975,666

(22) PCT Filed: Mar. 1, 2019

(86) PCT No.: PCT/JP2019/008200
§ 371 (c)(1),
(2) Date: Aug. 25, 2020

(87) PCT Pub. No.: WO2019/172142
PCT Pub. Date: Sep. 12, 2019

(65) Prior Publication Data

US 2020/0406341 A1 Dec. 31, 2020

(30) Foreign Application Priority Data

Mar. 8, 2018 (JP) ..... JP2018-042106

(51) Int. Cl.
*B22D 11/115* (2006.01)
*B22D 11/128* (2006.01)
*B22D 11/16* (2006.01)

(52) U.S. Cl.
CPC ..... *B22D 11/115* (2013.01); *B22D 11/128* (2013.01); *B22D 11/16* (2013.01)

(58) Field of Classification Search
CPC ..... B22D 11/115; B22D 11/128; B22D 11/16
See application file for complete search history.

(56) References Cited

U.S. PATENT DOCUMENTS

2011/0036533 A1 2/2011 Okada et al.
2012/0012274 A1 1/2012 Okada et al.

FOREIGN PATENT DOCUMENTS

CN 102527956 A 7/2012
CN 104226949 A 12/2014
(Continued)

OTHER PUBLICATIONS

International Search Report for PCT/JP2019/008200 (PCT/ISA/210) dated May 21, 2019.

*Primary Examiner* — Kevin P Kerns
*Assistant Examiner* — Steven S Ha
(74) *Attorney, Agent, or Firm* — SOLARIS Intellectual Property Group, PLLC

(57) ABSTRACT

A continuous casting method includes, conveying a cast slab from a casting mold, stirring a non-solidified portion in the cast slab with a first electromagnetic stirring device, stirring the non-solidified portion with a second electromagnetic stirring device disposed downstream of the first electromagnetic stirring device in a conveyance direction of the cast slab, and subsequently, rolling the cast slab with a reduction roll, in which, the first electromagnetic stirring device alternately imparts the cast slab with electromagnetic force in one direction to cause the non-solidified portion to flow toward one width direction side of the cast slab at a flow rate of at least 5 cm/s, and with electromagnetic force in another direction to cause the non-solidified portion to flow toward another width direction side of the cast slab at a flow rate of at least 5 cm/s.

6 Claims, 7 Drawing Sheets

(56) References Cited

FOREIGN PATENT DOCUMENTS

| | | | |
|---|---|---|---|
| JP | 2005-305517 | A | 11/2005 |
| JP | 2010-179342 | A | 8/2010 |
| JP | 2017-109228 | A | 6/2017 |
| JP | 2018-140415 | A | 9/2018 |
| WO | WO 2009/133739 | A1 | 11/2009 |

FIG.4

| Type | Cast slab specifications | | | First electromagnetic stirring device settings | | | Reduction roll settings | | Cast slab evaluation results | | | | |
|---|---|---|---|---|---|---|---|---|---|---|---|---|---|
| | Thickness T (mm) | Conveyance speed $V_C$ (m/min) | Solidified shell thickness D when passing first electromagnetic stirring device (mm) | Stirring method | Frequency F of alternating current (Hz) | Flow rate at solidification interface (cm/s) | Center solid phase ratio during rolling | Reduction rolling amount (mm) | Minimum value of Mn segregation ratio at center line region (-) | Minimum value of Mn segregation ratio at region L1 (-) | Minimum value of Mn segregation ratio at region L2 (-) | Presence of macrosegregation | Presence of semi-macrosegregation |
| Example 1 | 250 | 1.1 | 68 | Alternate stirring | 1.5 | 10.0 | 0.10 | 28 | 0.94 | 0.96 | 0.97 | No | No |
| Example 2 | 300 | 0.7 | 87 | Alternate stirring | 1.5 | 6.0 | 0.01 | 30 | 0.93 | 0.97 | 0.97 | No | No |
| Example 3 | 250 | 1.1 | 68 | Alternate stirring | 2.0 | 13.0 | 0.01 | 35 | 0.92 | 0.95 | 0.96 | No | No |
| Example 4 | 250 | 1.1 | 68 | Alternate stirring | 1.3 | 8.0 | 0.20 | 25 | 0.95 | 0.97 | 0.97 | No | No |
| Example 5 | 300 | 0.7 | 87 | Alternate stirring | 1.8 | 5.0 | 0.05 | 25 | 0.94 | 0.98 | 0.97 | No | No |
| Comparative example 1 | 250 | 1.1 | 68 | Single direction stirring | 1.5 | 8.0 | 0.10 | 28 | 0.96 | 0.97 | 0.97 | No | Yes |
| Comparative example 2 | 250 | 1.1 | 68 | Alternate stirring | 1.0 | 3.5 | 0.01 | 34 | 0.96 | 0.99 | 0.99 | Yes | Yes |
| Comparative example 3 | 250 | 1.1 | 68 | Alternate stirring | 4.0 | 4.5 | 0.20 | 26 | 0.97 | 0.99 | 0.98 | No | Yes |

CONTINUOUS CASTING METHOD, CAST SLAB, AND CONTINUOUS CASTING APPARATUS

TECHNICAL FIELD

Technology disclosed herein relates to a continuous casting method, a cast slab, and a continuous casting apparatus.

BACKGROUND ART

Continuous casting methods exist in which a non-solidified portion in a cast slab conveyed from a casting mold is stirred using an electromagnetic stirring device (for example Japanese Patent Application Laid-Open (JP-A) Nos. 2010-179342 and 2005-305517, and International Publication (WO) No. 2009/133739).

SUMMARY OF INVENTION

Technical Problem

Technology exists to suppress molten steel with an increased concentration of a particular component due to segregation (solidification segregation) (referred to hereafter as "concentrated molten steel") from remaining in a cast slab as macrosegregation. Such technology includes technology in which a cast slab including a non-solidified portion is rolled with a reduction roll and the concentrated molten steel in the non-solidified portion is pushed back (expelled) from the reduction roll toward a casting mold.

However, concentrated molten steel that has been pushed back from the reduction roll toward the casting mold does not readily mix with molten steel (base molten steel) being conveyed from the casting mold toward the reduction roll. There is thus further room for improvement with regard to suppressing concentrated molten steel from remaining as macrosegregation in a cast slab.

When plural dendrites are present in a non-solidified portion of a cast slab, these dendrites resist (obstruct) the flow of the concentrated molten steel that is being pushed back from the reduction roll toward the casting mold. This makes it more difficult to push back the concentrated molten steel from the reduction roll toward the casting mold, and thus makes macrosegregation more likely to remain in the cast slab.

Moreover, semi-macrosegregation readily becomes trapped between neighboring dendrites. Accordingly, the presence of dendrites in the non-solidified portion of a cast slab makes semi-macrosegregation more likely to remain in the cast slab.

An object of the technology disclosed herein is to reduce macrosegregation and semi-macrosegregation in a cast slab.

Solution to Problem

In a continuous casting method according to a first aspect, includes, conveying a cast slab from a casting mold, stirring a non-solidified portion in the cast slab with a first electromagnetic stirring device, stirring the non-solidified portion with a second, electromagnetic stirring device disposed downstream of the first electromagnetic stirring device in a conveyance direction of the cast slab, and subsequently, rolling the cast slab with a reduction roll, in which, the first electromagnetic stirring device alternately imparts the cast slab with electromagnetic force in one direction to cause the non-solidified portion to flow toward one width direction side of the cast slab at a flow rate of at least 5 cm/s, and with electromagnetic force in another direction to cause the non-solidified portion to flow toward another width direction side of the cast slab at a flow rate of at least 5 cm/s.

In the continuous casting method according to the first aspect, the non-solidified portion in the cast slab conveyed from the casting mold is respectively stirred with the first electromagnetic stirring device and the second electromagnetic stirring device.

The cast slab containing the non-solidified portion is then rolled with the reduction roll. Concentrated molten steel in the non-solidified portion is thereby pushed back (expelled) from the reduction roll toward the casting mold.

The first electromagnetic stirring device alternately imparts the cast slab with electromagnetic force in the one direction to cause the non-solidified portion to flow toward the one width direction side of the cast slab at a flow rate of at least 5 cm/s, and with electromagnetic force in the other direction to cause the non-solidified portion to flow toward the other width direction side of the cast slab at a flow rate of at least 5 cm/s.

Due to the non-solidified portion flowing toward the one width direction side of the cast slab at a flow rate of at least 5 cm/s with electromagnetic force in the one direction, shear force of a predetermined value or greater acts on the tips of dendrites in the non-solidified portion. Similarly, due to the non-solidified portion flowing toward the other width direction side of the cast slab at a flow rate of at least 5 cm/s with the electromagnetic force in the other direction, shear force of a predetermined value or greater acts on the tips of the dendrites in the non-solidified portion. This snaps off the tips of the dendrites, facilitating the formation of equiaxed grains.

The first electromagnetic stirring device alternately imparts the cast slab with electromagnetic force in the one direction and electromagnetic force in the other direction. Accordingly, in the present aspect, the tips of the dendrites in the non-solidified portion can be snapped off more easily than in cases in which the first electromagnetic stirring device only causes the non-solidified portion to flow toward one width direction side of the cast slab.

Snapping off the tips of the dendrites reduces flow resistance (obstacles) to concentrated molten steel being pushed back from the reduction roll toward the casting mold. This makes it easier to push back the concentrated molten steel from the reduction roll toward the casting mold. The concentrated molten steel is thus further suppressed from remaining as macrosegregation in the cast slab.

Moreover, using the first electromagnetic stirring device to snap off the tips of the dendrites reduces trapping of semi-macrosegregation between the dendrites. Semi-macrosegregation is thus suppressed from remaining in the cast slab.

Accordingly, the present aspect enables macrosegregation and semi-macrosegregation in the cast slab to be reduced.

A continuous casting method according to a second aspect is the continuous casting method according to the first aspect, in which, the first electromagnetic stirring device intermittently imparts the cast slab with electromagnetic force in the one direction and electromagnetic force in the other direction.

In this continuous casting method, the first electromagnetic stirring device intermittently imparts the cast slab with electromagnetic force in the one direction and electromagnetic force in the other direction. Namely, the first electromagnetic stirring device imparts the cast slab with electromagnetic force in the one direction and electromagnetic force in the other direction separated by an interval.

Accordingly, for example, the flow rate of the non-solidified portion decreases between stopping imparting electromagnetic force in the one direction and starting to impart electromagnetic force in the other direction to the cast slab. Thus, when starting to impart electromagnetic force in the other direction to the cast slab, the direction of flow of the non-solidified portion therefore reverses smoothly, making it easier to cause the non-solidified portion to flow toward the other width direction side of the cast slab. Similarly, when the electromagnetic force imparted to the cast slab is switched from electromagnetic force in the other direction to electromagnetic force in the one direction, the direction of flow of the non-solidified portion reverses smoothly, making it easier to cause the non-solidified portion to flow toward the one width direction side of the cast slab.

This enables the tips of the dendrites in the non-solidified portion to be snapped off while reducing the power consumption of the first electromagnetic stirring device.

A continuous casting method according to a third aspect is the continuous casting method according to the first aspect or the second aspect, in which, the cast slab includes a solidified shell enclosing the non-solidified portion, and an alternating current satisfying the following Equation (1) is applied to the first electromagnetic stirring device so as to cause the first electromagnetic stirring device to generate electromagnetic force in the one direction and electromagnetic force in the other direction.

In this continuous casting method, an alternating current satisfying Equation (1) is applied to the first electromagnetic stirring device so as to cause the first electromagnetic stirring device to generate electromagnetic force in the one direction and electromagnetic force in the other direction.

Note that the positions of the tips of the dendrites in the non-solidified portion fluctuate according to the thickness of the solidified shell. Specifically, as the thickness of the solidified shell increases, the positions of the tips of the dendrites move toward the thickness direction center of the cast slab. As the thickness of the solidified shell decreases, the positions of the tips of the dendrites move toward the surface in the thickness direction of the cast slab.

Moreover, the depth (penetration depth) at which the electromagnetic force (electromagnetic force in the one direction and electromagnetic force in the other direction) penetrates the cast slab fluctuates according to the frequency of the alternating current applied to the first electromagnetic stirring device. Specifically, the lower the frequency of the alternating current applied to an electromagnetic coil of the first electromagnetic stirring device, the deeper the penetration depth of the electromagnetic force into the cast slab. Conversely, the higher the frequency of the alternating current applied to the electromagnetic coil of the first electromagnetic stirring device, the shallower the penetration depth of the electromagnetic force into the cast slab.

Thus, in the present aspect, an alternating current with a frequency that satisfies Equation (1) is applied to the first electromagnetic stirring device. Specifically, the frequency of the alternating current applied to the first electromagnetic stirring device is lowered as the thickness of the solidified shell increases. Conversely, the frequency of the alternating current applied to the first electromagnetic stirring device is raised as the thickness of the solidified shell decreases.

Accordingly, electromagnetic force in the one direction and electromagnetic force in the other direction can be caused to act on the tips of the dendrites, regardless of the thickness of the solidified shell. This enables the tips of the dendrites to be snapped off efficiently.

A continuous casting method according to a fourth aspect is the continuous casting method according to any one of the first aspect to the third aspect, in which, the electromagnetic force in the one direction and the electromagnetic force in the other direction each produce a flow rate of at least 5 cm/s at a solidification interface of the non-solidified portion.

In this continuous casting method, electromagnetic force in the one direction and electromagnetic force in the other direction each produce a flow rate of at least 5 cm/s at the solidification interface of the non-solidified portion. This enables the tips of the dendrites to be snapped off efficiently.

A continuous casting method according to a fifth aspect is the continuous casting method according to any one of the first aspect to the fourth aspect, wherein the second electromagnetic stirring device stirs molten steel in the non-solidified portion that has been pushed back toward the casting mold by the reduction roll.

In this continuous casting method, the second electromagnetic stirring device stirs (electromagnetically stirs) the concentrated molten steel in the non-solidified portion that has been pushed back from the reduction roll toward the casting mold. This facilitates mixing of the concentrated molten steel that has been pushed back from the reduction roll toward the casting mold with the molten steel (base molten steel) that is being conveyed from the casting mold toward the reduction roll. The concentrated molten steel is diluted as a result. The concentrated molten steel is thereby suppressed from remaining as macrosegregation in the cast slab.

A continuous casting method according to a sixth aspect is the continuous casting method according to any one of the first aspect to the fifth aspect, in which, the second electromagnetic stirring device alternately imparts the cast slab with electromagnetic force in the one direction to cause the non-solidified portion to flow toward the one width direction side of the cast slab and with electromagnetic force in the other direction to cause the non-solidified portion to flow toward the other width direction side of the cast slab.

In this continuous casting method, the second electromagnetic stirring device alternately imparts the cast slab with electromagnetic force in the one direction to cause the non-solidified portion to flow toward the one width direction side of the cast slab and electromagnetic force in the other direction to cause the non-solidified portion to flow toward the other width direction side of the cast slab. This further facilitates mixing of the concentrated molten steel that has been pushed back from the reduction roll toward the casting mold with the molten steel (base molten steel) that is being conveyed from the casting mold toward the reduction roll. The concentrated molten steel is diluted as a result. The concentrated molten steel is thereby further suppressed from remaining as macrosegregation in the cast slab.

A continuous casting method according to a seventh aspect is the continuous casting method according to any one of the first aspect to the sixth aspect, wherein a thickness of the cast slab is in a range of from 250 mm to 300 mm, a conveyance speed of the cast slab is in a range of from 0.7 m/min to 1.1 m/min, and the first electromagnetic stirring device is disposed in a range of from 6 m to 10 m downstream of a meniscus in the casting mold along the conveyance direction of the cast slab.

In this continuous casting method, the thickness of the cast slab is in a range of from 250 mm to 300 mm. Moreover, the conveyance speed of the cast slab is in a range of from 0.7 m/min to 1.1 m/min. Furthermore, the first electromagnetic stirring device is disposed in a range of from 6 m to 10 m downstream of the meniscus in the casting mold along the conveyance direction of the cast slab.

The tips of the dendrites in the non-solidified portion of the cast slab are thereby efficiently snapped off by the first electromagnetic stirring device, enabling the formation of equiaxed grains. This enables macrosegregation and semi-macrosegregation in the cast slab to be further reduced.

A cast slab according to an eighth aspect includes, a center line negative segregation band that is generated at a thickness direction center line region of the cast slab and that has a minimum value of an Mn segregation ratio in a range of from 0.92 to 0.95, a surface side negative segregation band that is generated in a region L1 as defined in the following Equation (3) in the cast slab and that has a minimum value of an Mn segregation ratio in a range of from 0.95 to 0.98, and an intermediate negative segregation band that is generated in a region L2, as defined in the following Equation (4), between the center line region and the region L1 in the cast slab, and that has a minimum value of an Mn segregation ratio in a range of from 0.96 to 0.97.

The cast slab includes the center line negative segregation band, the surface side negative segregation band, and the intermediate negative segregation band. The center line negative segregation band is generated at the thickness direction center line region of the cast slab. The minimum value of the Mn segregation ratio of the center line negative segregation band is in a range of from 0.92 to 0.95.

The surface side negative segregation band is generated in the region L1 as defined in Equation (3). The minimum value of the Mn segregation ratio of the surface side negative segregation band is in a range of from 0.95 to 0.98.

The intermediate negative segregation band is generated in the region L2 as defined in Equation (4) between the center line region and the region L1. The minimum value of the Mn segregation ratio of the intermediate negative segregation band is in a range of from 0.96 to 0.97.

A cast slab including the center line negative segregation band, the surface side negative segregation band, and the intermediate negative segregation band that are prescribed in this manner is for example continuously cast using the continuous casting method according to any one of the first aspect to the seventh aspect.

A continuous casting apparatus according to a ninth aspect includes, a casting mold, a first electromagnetic stirring device configured to stir a non-solidified portion in a cast slab conveyed from the casting mold, a second electromagnetic stirring device disposed downstream of the first electromagnetic stirring device in a conveyance direction of the cast slab and configured to stir the non-solidified portion, a reduction roll disposed downstream of the second electromagnetic stirring device in the conveyance direction of the cast slab and configured to roll the cast slab, and a control section configured to cause the first electromagnetic stirring device to alternately generate electromagnetic force in one direction to cause the non-solidified portion to flow toward one width direction side of the cast slab at a flow rate of at least 5 cm/s, and electromagnetic force in another direction to cause the non-solidified portion to flow toward another width direction side of the cast slab at a flow rate of at least 5 cm/s.

In this continuous casting apparatus, the non-solidified portion in the cast slab conveyed from the casting mold is respectively stirred by the first electromagnetic stirring device and the second electromagnetic stirring device.

The cast slab containing the non-solidified portion is then rolled by the reduction roll. Concentrated molten steel in the non-solidified portion is thereby pushed back (expelled) from the reduction roll toward the casting mold.

The control section controls the first electromagnetic stirring device. Thus, the first electromagnetic stirring device alternately imparts the cast slab with electromagnetic force in the one direction to cause the non-solidified portion to flow toward the one width direction side of the cast slab at a flow rate of at least 5 cm/s, and electromagnetic force in the other direction to cause the non-solidified portion to flow toward the other width direction side of the cast slab at a flow rate of at least 5 cm/s.

Due to the non-solidified portion flowing toward the one width direction side of the cast slab at a flow rate of at least 5 cm/s under electromagnetic force in the one direction, shear force of a predetermined value or greater acts on the tips of dendrites in the non-solidified portion. Similarly, due to the non-solidified portion flowing toward the other width direction side of the cast slab at a flow rate of at least 5 cm/s under electromagnetic force in the other direction, shear force of a predetermined value or greater acts on the tips of the dendrites in the non-solidified portion. This snaps off the tips of the dendrites, facilitating the formation of equiaxed grains.

The first electromagnetic stirring device alternately imparts the cast slab with electromagnetic force in the one direction and electromagnetic force in the other direction. Accordingly, in the present aspect, the tips of the dendrites in the non-solidified portion can be snapped off more easily than in cases in which the first electromagnetic stirring device only causes the non-solidified portion to flow toward one width direction side of the cast slab.

Snapping off the tips of the dendrites reduces flow resistance (obstacles) to concentrated molten steel being pushed back from the reduction roll toward the casting mold. This makes it easier to push back the concentrated molten steel from the reduction roll toward the casting mold. The concentrated molten steel is thus further suppressed from remaining as macrosegregation in the cast slab.

Moreover, using the first electromagnetic stirring device to snap off the tips of the dendrites reduces trapping of semi-macrosegregation between the dendrites. Semi-macrosegregation is thus suppressed from remaining in the cast slab.

Accordingly, the present aspect enables macrosegregation and semi-macrosegregation in the cast slab to be reduced.

A continuous casting apparatus according to a tenth aspect is the continuous casting apparatus according to the ninth aspect, in which, the control section causes the first electromagnetic stirring device to intermittently generate electromagnetic force in the one direction and electromagnetic force in the other direction.

In this continuous casting apparatus, the control section controls the first electromagnetic stirring device. Thus, the first electromagnetic stirring device intermittently imparts the cast slab with electromagnetic force in the one direction and electromagnetic force in the other direction. Namely, the first electromagnetic stirring device imparts the cast slab with electromagnetic force in the one direction and electromagnetic force in the other direction separated by an interval.

Accordingly, for example, the flow rate of the non-solidified portion decreases between stopping imparting electromagnetic force in the one direction and starting to impart electromagnetic force in the other direction to the cast slab. Thus, when starting to impart electromagnetic force in the other direction to the cast slab, the direction of flow of the non-solidified portion therefore reverses smoothly, making it easier to cause the non-solidified portion to flow toward the other width direction side of the cast slab. Similarly, when the electromagnetic force imparted to the cast slab is switched from electromagnetic force in the other direction to electromagnetic force in the one direction, the direction of flow of the non-solidified portion reverses smoothly, making it easier to cause the non-solidified portion to flow toward the one width direction side of the cast slab.

This enables the tips of the dendrites in the non-solidified portion to be snapped off while reducing the power consumption of the first electromagnetic stirring device.

A continuous casting apparatus according to an eleventh aspect is the continuous casting apparatus according to the ninth aspect or the tenth aspect, in which, the cast slab includes a solidified shell enclosing the non-solidified portion, and the control section applies an alternating current that satisfies the following Equation (1) to the first electromagnetic stirring device to cause the first electromagnetic stirring device to generate electromagnetic force in the one direction and electromagnetic force in the other direction.

In this continuous casting apparatus, the control section applies an alternating current satisfying Equation (1) to the first electromagnetic stirring device so as to cause the first electromagnetic stirring device to generate electromagnetic force in the one direction and electromagnetic force in the other direction.

Note that the positions of the tips of the dendrites in the non-solidified portion fluctuate according to the thickness of the solidified shell. Specifically, as the thickness of the solidified shell increases, the positions of the tips of the dendrites move toward the thickness direction center of the cast slab. Conversely, as the thickness of the solidified shell decreases, the positions of the tips of the dendrites move toward the surface in the thickness direction of the cast slab.

Moreover, the depth (penetration depth) at which the electromagnetic force (electromagnetic force in the one direction and electromagnetic force in the other direction) penetrates the cast slab fluctuates according to the frequency of the alternating current applied to the first electromagnetic stirring device. Specifically, the lower the frequency of the alternating current applied to the electromagnetic coil of the first electromagnetic stirring device, the deeper the penetration depth of the electromagnetic force into the cast slab. Conversely, the higher the frequency of the alternating current applied to the electromagnetic coil of the first electromagnetic stirring device, the shallower the penetration depth of the electromagnetic force into the cast slab.

Thus, the control section applies an alternating current with a frequency that satisfies Equation (1) to the first electromagnetic stirring device. Specifically, the frequency of the alternating current applied to the first electromagnetic stirring device is lowered as the thickness of the solidified shell increases. Conversely, the frequency of the alternating current applied to the first electromagnetic stirring device is raised as the thickness of the solidified shell decreases.

Accordingly, electromagnetic force in the one direction and electromagnetic force in the other direction can be caused to act on the tips of the dendrites, regardless of the thickness of the solidified shell. This enables the tips of the dendrites to be snapped off efficiently.

A continuous casting apparatus according to a twelfth aspect is the continuous casting apparatus according to any one of the ninth aspect to the eleventh aspect, in which, the electromagnetic force in the one direction and the electromagnetic force in the other direction each produce a flow rate of at least 5 cm/s at a solidification interface of the non-solidified portion.

In this continuous casting apparatus, electromagnetic force in the one direction and electromagnetic force in the other direction each produce a flow rate of at least 5 cm/s at the solidification interface of the non-solidified portion. This enables the tips of the dendrites to be snapped off efficiently.

A continuous casting apparatus according to a thirteenth aspect is the continuous casting apparatus according to any one of the ninth aspect to the twelfth aspect, wherein the second electromagnetic stirring device stirs molten steel in the non-solidified portion that has been pushed back toward the casting mold by the reduction roll.

In this continuous casting apparatus, the second electromagnetic stirring device stirs (electromagnetically stirs) the concentrated molten steel in the non-solidified portion that has been pushed back from the reduction roll toward the casting mold. This facilitates mixing of the concentrated molten steel that has been pushed back from the reduction roll toward the casting mold with the molten steel (base molten steel) that is being conveyed from the casting mold toward the reduction roll. The concentrated molten steel is diluted as a result. The concentrated molten steel is thereby suppressed from remaining as macrosegregation in the cast slab.

A continuous casting apparatus according to a fourteenth aspect is the continuous casting apparatus according to any one of the ninth aspect to the thirteenth aspect, in which, the second electromagnetic stirring device alternately imparts the cast slab with electromagnetic force in the one direction to cause the non-solidified portion to flow toward the one width direction side of the cast slab and with electromagnetic force in the other direction to cause the non-solidified portion to flow toward the other width direction side of the cast slab.

In this continuous casting apparatus, the second electromagnetic stirring device alternately imparts the cast slab with electromagnetic force in the one direction to cause the non-solidified portion to flow toward the one width direction side of the cast slab and electromagnetic force in the other direction to cause the non-solidified portion to flow toward the other width direction side of the cast slab. This further facilitates mixing of the concentrated molten steel that has been pushed back from the reduction roll toward the casting mold with the molten steel (base molten steel) that is being conveyed from the casting mold toward the reduction roll. The concentrated molten steel is diluted as a result. The concentrated molten steel is thereby further suppressed from remaining as macrosegregation in the cast slab.

Advantageous Effects of Invention

The technology disclosed herein enables macrosegregation and semi-macrosegregation in a cast slab to be reduced.

BRIEF DESCRIPTION OF DRAWINGS

FIG. 4 is a table giving cast slab specifications and first electromagnetic stirring device settings employed in continuous casting testing, and cast slab evaluation results.

DESCRIPTION OF EMBODIMENTS

Explanation follows regarding a continuous casting apparatus and a continuous casting method according to an exemplary embodiment.

Continuous Casting Apparatus

First, explanation follows regarding configuration of the continuous casting apparatus.

Figure 1:
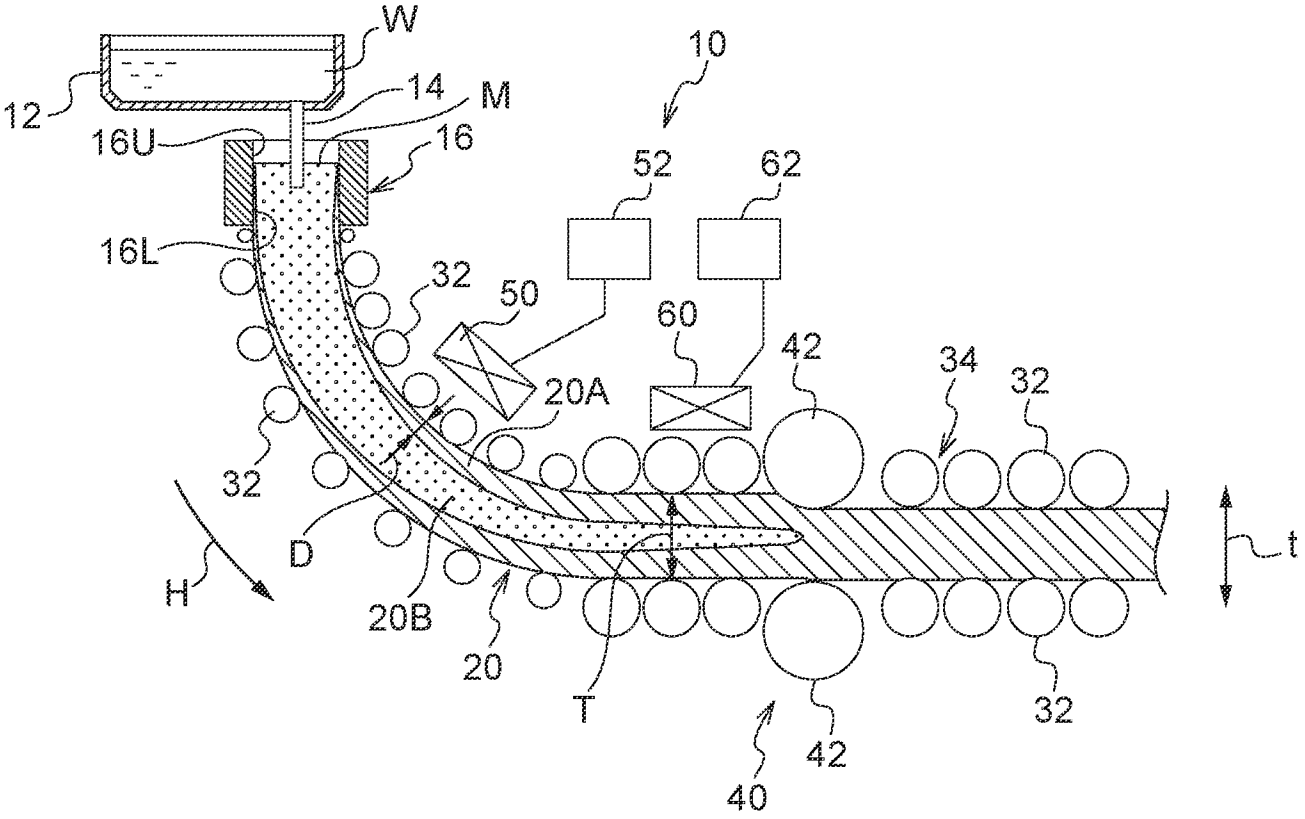
FIG. 1 is a side view illustrating a continuous casting apparatus according to an exemplary embodiment as viewed from a width direction of a cast slab.

FIG. 1 illustrates a continuous casting apparatus 10 according to the present exemplary embodiment. The continuous casting apparatus 10 includes a tundish 12, a casting mold 16, a conveyance device 30, a reduction rolling device 40, a first electromagnetic stirring device 50, and a second electromagnetic stirring device 60.

Tundish

The tundish 12 is a container that temporarily holds molten steel W. The molten steel W is poured into the tundish 12 from a non-illustrated ladle. A pickling nozzle 14 through which the molten steel W is discharged is provided in a bottom portion of the tundish 12. The casting mold 16 is disposed below the tundish 12.

Casting Mold

The casting mold 16 is, for example, a water-cooled copper casting mold. The casting mold 16 cools the molten steel W poured through the pickling nozzle 14 of the tundish 12, thereby solidifying a surface layer of the molten steel W. A cast slab 20 is thus molded in a predetermined shape.

The casting mold 16 is formed in a tube shape that is open at both axial direction ends. The casting mold 16 is disposed with its axial direction running in an up-down direction. A pour-in opening 16U is formed in an upper end of the casting mold 16. The pickling nozzle 14 of the tundish 12 is inserted into the opening 16U. The molten steel W is poured into the casting mold 16 through the pickling nozzle 14.

Note that the pickling nozzle 14 is provided with a regulating mechanism such as a regulating valve to regulate the discharge rate of the molten steel W. This regulating mechanism regulates the discharge rate of the molten steel W discharged into the opening 16U through the pickling nozzle 14 such that the surface of the molten steel W in the casting mold 16 (referred to hereafter as the "meniscus M") is at a predetermined height.

The molten steel W poured into the casting mold 16 is cooled by the casting mold 16 so as to be gradually solidified from the surface layer thereof. The surface layer of the molten steel W is solidified in this manner so as to form the cast slab 20 inside which molten steel W is still present. The casting mold 16 has a rectangular cross-section profile. The cast slab 20 is accordingly molded with a rectangular cross-section profile. Note that in the following explanation, a surface layer side of the cast slab 20 of solidified molten steel W is referred to as a solidified shell 20A, and the non-solidified molten steel W remaining inside the cast slab 20 is referred to as a non-solidified portion 20B.

A discharge opening 16L is formed in a lower end of the casting mold 16. The cast slab 20 molded in the casting mold 16 is discharged through the discharge opening 16L. The conveyance device 30 is disposed at a lower side of the casting mold 16.

Conveyance Device

The conveyance device 30 conveys the cast slab 20 discharged from the casting mold 16 in a predetermined direction (arrow H direction) while cooling the cast slab 20. Note that in the following explanation, the arrow H direction configures a conveyance direction (casting direction) of the conveyance device 30.

The conveyance device 30 includes plural pairs of support rolls 32. The plural pairs of support rolls 32 are arranged at intervals from each other in the conveyance direction of the cast slab 20 and on either side of the cast slab 20 in a thickness direction of the cast slab 20 (arrow t direction). The two axial direction end portions of each of the support rolls 32 are rotatably supported on both width direction sides of the cast slab 20 by non-illustrated shaft bearings. The support rolls 32 form a conveyance path 34 that gently curves from the discharge opening 16L of the casting mold 16 toward the reduction rolling device 40, described later, before extending substantially in a horizontal direction.

The plural pairs of support rolls 32 convey the cast slab 20 along the conveyance direction while gripping the cast slab 20 from both thickness direction sides. Bulging due to the cast slab 20 distending in the thickness direction is thus suppressed. Some of the plural support rolls 32 are configured by driven rolls that are rotationally driven. The driven rolls regulate the conveyance speed (casting speed) of the cast slab 20.

Note that increasing the rotation speed of the driven rolls increases the conveyance speed of the cast slab 20. Decreasing the rotation speed of the driven rolls decreases the conveyance speed of the cast slab 20.

The conveyance device 30 includes plural cooling devices (secondary cooling devices), not illustrated in the drawings, to cool the cast slab 20. As an example, the plural cooling devices include spray nozzles to spray cooling water. The cooling devices are arranged at intervals from each other in the conveyance direction of the cast slab 20, and spray cooling water toward the cast slab 20. The cast slab 20 is thus cooled so as to gradually solidify the non-solidified portion 20B of the cast slab 20.

Note that increasing the amount of cooling water sprayed onto the cast slab 20 from the cooling devices increases the rate of cooling of the cast slab 20. Decreasing the amount of cooling water sprayed onto the cast slab 20 from the cooling devices decreases the rate of cooling of the cast slab 20. Moreover, lowering the temperature of the cooling water sprayed onto the cast slab 20 from the cooling devices increases the rate of cooling of the cast slab 20. Raising the temperature of the cooling water sprayed onto the cast slab 20 from the cooling devices decreases the rate of cooling of the cast slab 20.

The conveyance path 34 may be provided with an electromagnetic stirring device to electromagnetically stir the non-solidified portion 20B of the cast slab 20.

Press Device

The reduction rolling device 40 is disposed at the downstream side of where the conveyance path 34 extends substantially in the horizontal direction. The reduction rolling device 40 includes a pair of reduction rolls (large reduction rolls) 42. The pair of reduction rolls 42 convey the cast slab 20 in the conveyance direction while gripping the cast slab 20 from both thickness direction sides of the cast slab 20. Namely, the pair of reduction rolls 42 form the conveyance path 34 of the cast slab 20.

The pair of reduction rolls 42 roll the cast slab 20 containing the non-solidified portion 20B so as to push back (expel) concentrated molten steel in the non-solidified portion 20B from between the pair of reduction rolls 42 toward the conveyance direction upstream side of the cast slab 20. This suppresses the concentrated molten steel from remaining as macrosegregation at a thickness direction central portion of the cast slab 20.

The pair of reduction rolls 42 are formed in circular column shapes. The pair of reduction rolls 42 are disposed on respective thickness direction sides of the cast slab 20. The pair of reduction rolls 42 are disposed such that the axial direction (length direction) thereof runs in the width direction of the cast slab 20. The two axial direction end portions of each of the pair of reduction rolls 42 are rotatably supported by non-illustrated shaft bearings on respective width direction sides of the cast slab 20.

The reduction roll 42 disposed at the upper side of the cast slab 20 presses (rolls) the cast slab 20 through a press device configured by a hydraulic cylinder or the like. Specifically, the press device applies pressure toward the thickness direction center of the cast slab 20 (the lower side) to the shaft bearings that support the two axial direction end portions of the reduction roll 42 disposed at the upper side of the cast slab 20. The cast slab 20 is thus squeezed in its thickness direction between the pair of reduction rolls 42.

Note that the cast slab 20 is conveyed while being cooled by the plural cooling devices of the conveyance device 30 as described above. The non-solidified portion 20B of the cast slab 20 therefore gradually solidifies on progression downstream in the conveyance direction. In other words, a solid phase ratio R of the cast slab 20 increases as the cast slab 20 moves downstream in the conveyance direction.

The pair of reduction rolls 42 of the present exemplary embodiment are disposed on the conveyance path 34 of the cast slab 20 at a position where the solid phase ratio R at the thickness direction central portion of the cast slab 20 (referred to hereafter as the "center solid phase ratio") is less than 0.8 ($R<0.8$). The cast slab 20 containing the non-solidified portion 20B where the center solid phase ratio R is less than 0.8 is thereby rolled by the pair of reduction rolls 42.

Note that the solid phase ratio R refers to the proportion (ratio) of a solidified portion with respect to the cast slab 20. For example, when the solid phase ratio R is 0.8, a solidified portion makes up eight tenths (80%) of the cast slab 20, and a non-solidified portion makes up two tenths (20%) of the cast slab 20. The solid phase ratio R is, for example, found by performing solidification analysis on the cast slab 20.

First Electromagnetic Stirring Device

The first electromagnetic stirring device 50 is a contact-free stirring device that imparts the non-solidified portion 20B of the cast slab 20 being conveyed from the casting mold 16 by the conveyance device 30 with electromagnetic force in order to stir (electromagnetically stir) the non-solidified portion 20B.

The first electromagnetic stirring device 50 is disposed downstream of the casting mold 16 in the conveyance direction of the cast slab 20. Moreover, the first electromagnetic stirring device 50 is disposed upstream of the pair of reduction rolls 42 in the conveyance direction of the cast slab 20. The first electromagnetic stirring device 50 is disposed opposing the solidified shell 20A on an upper face of the cast slab 20 as it passes the curved section of the conveyance path 34. Note that the first electromagnetic stirring device 50 may be disposed at the lower side of the cast slab 20.

The first electromagnetic stirring device 50 stirs the non-solidified portion 20B at a surface layer portion of the cast slab 20. In other words, the first electromagnetic stirring device 50 stirs the non-solidified portion 20B at a stage when a solidification interface of the non-solidified portion 20B is present at the surface layer portion of the cast slab 20. The first electromagnetic stirring device 50 also stirs the non-solidified portion 20B of the cast slab 20 at a position that the concentrated molten steel in the non-solidified portion 20B does not reach due to being pushed back toward the upstream side in the conveyance direction of the cast slab 20 by the pair of reduction rolls 42.

The first electromagnetic stirring device 50 includes a non-illustrated electromagnetic coil (induction body) that opposes the solidified shell 20A of the cast slab 20. When an alternating current (three-phase alternating current) is applied to the electromagnetic coil, a magnetic field that moves in the width direction of the cast slab 20 (referred to hereafter as a "moving magnetic field") is generated. The moving magnetic field acts on the non-solidified portion 20B to generate electromagnetic force EP (see FIG. 3) to cause the non-solidified portion 20B to flow in the width direction of the cast slab 20.

Note that from the perspective of efficient equiaxed crystal formation, the first electromagnetic stirring device 50 is preferably disposed at a position at which a conveyance direction center of the cast slab 20, at the first electromagnetic stirring device 50, is positioned in a range of from 6 m to 10 m downstream of the meniscus M in the casting mold 16 along the conveyance direction of the cast slab 20.

First Control Section

A first control section 52 is electrically connected to the first electromagnetic stirring device 50. The first control section 52 controls the electromagnetic force EP generated by the first electromagnetic stirring device 50 such that the flow rate at the solidification interface of the non-solidified portion 20B is at least 5 cm/s. The first control section 52 is an example of a control section.

Specifically, by increasing the value of the alternating current applied to the electromagnetic coil of the first electromagnetic stirring device 50, the first control section 52 increases the electromagnetic force EP. Conversely, by decreasing the value of the alternating current applied to the electromagnetic coil, the first control section 52 decreases the electromagnetic force EP.

Note that dendrites form from the solidified shell 20A toward the thickness direction center of the cast slab 20 during the solidification process of the non-solidified portion 20B. The positions of tips of the dendrites, namely of the solidification interface of the non-solidified portion 20B, fluctuate according to the thickness of the solidified shell 20A. Specifically, as the thickness of the solidified shell 20A increases, the position of the solidification interface of the non-solidified portion 20B moves toward the thickness direction center of the cast slab 20.

The depth at which the electromagnetic force EP penetrates into the cast slab 20 (penetration depth) fluctuates according to the frequency of the alternating current applied to the electromagnetic coil of the first electromagnetic stirring device 50. Specifically, the lower the frequency of the alternating current applied to the electromagnetic coil of the first electromagnetic stirring device 50, the deeper the penetration depth of the electromagnetic force EP into the cast slab 20. The higher the frequency of the alternating current applied to the electromagnetic coil of the first electromagnetic stirring device 50, the shallower the penetration depth of the electromagnetic force EP into the cast slab 20.

The first control section 52 raises or lowers the frequency of the alternating current applied to the electromagnetic coil of the first electromagnetic stirring device 50 according to the thickness of the solidified shell 20A. Specifically, the greater the thickness of the solidified shell 20A, the lower the frequency of the alternating current applied to the electromagnetic coil of the first electromagnetic stirring device 50. Conversely, the lower the thickness of the solidified shell 20A, the higher the frequency of the alternating current applied to the electromagnetic coil of the first electromagnetic stirring device 50.

Figure 2:
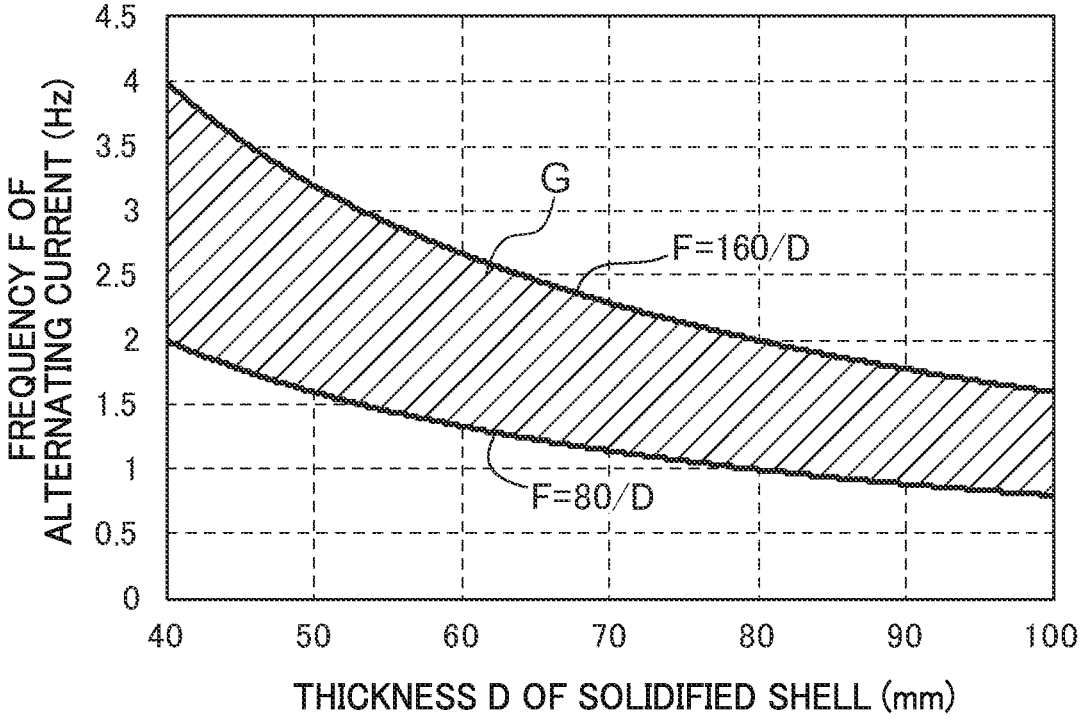
FIG. 2 is a graph illustrating a relationship between a thickness D of a solidified shell of a cast slab and a frequency F of an alternating current applied to an electromagnetic coil of a first electromagnetic stirring device.

More detailed explanation follows regarding this. FIG. 2 illustrates analysis results illustrating a relationship between a thickness D of the solidified shell 20A and the frequency of the alternating current applied to the first electromagnetic stirring device 50. Note that the thickness D of the solidified shell 20A is the thickness at a position (site) of the solidified shell 20A on the first electromagnetic stirring device 50 side of the cast slab 20 that opposes the center of the first electromagnetic stirring device 50 in the conveyance direction of the cast slab 20. The thickness D of the solidified shell 20A is found by solidification analysis. The diagonally shaded region G in FIG. 2 is a region where the flow rate of the non-solidified portion 20B at the solidification interface is at least 5 cm/s.

As illustrated in FIG. 2, in the region G where the flow rate of the non-solidified portion 20B at the solidification interface is at least 5 cm/s, the frequency F of the alternating current applied to the electromagnetic coil of the first electromagnetic stirring device 50 is in a range of from 80/D to 160/D.

Accordingly, the first control section 52 applies an alternating current to the electromagnetic coil of the first electromagnetic stirring device 50 at a frequency F that satisfies Equation (1). Shear force of a predetermined value or greater accordingly acts on the tips of the dendrites that form in the vicinity of the solidification interface in the non-solidified portion 20B. The tips of the dendrites are snapped off as a result, facilitating the formation of equiaxed grains.

Equation (1)

$$\frac{80}{D} \leq F \leq \frac{160}{D} \quad (1)$$

wherein F is the frequency of the alternating current (Hz) and D is the thickness (mm) of the solidified shell at a side of the first electromagnetic stirring device.

A constant A is employed to convert Equation (1) to Equation (2) below.

Equation (2)

$$F = \frac{A}{D} \quad (2)$$

wherein A is a constant (80≤A≤160).

The first control section 52 also controls the orientation of the electromagnetic force EP acting on the non-solidified portion 20B by changing the orientation of the alternating current applied to the electromagnetic coil of the first electromagnetic stirring device 50.

Figure 3:
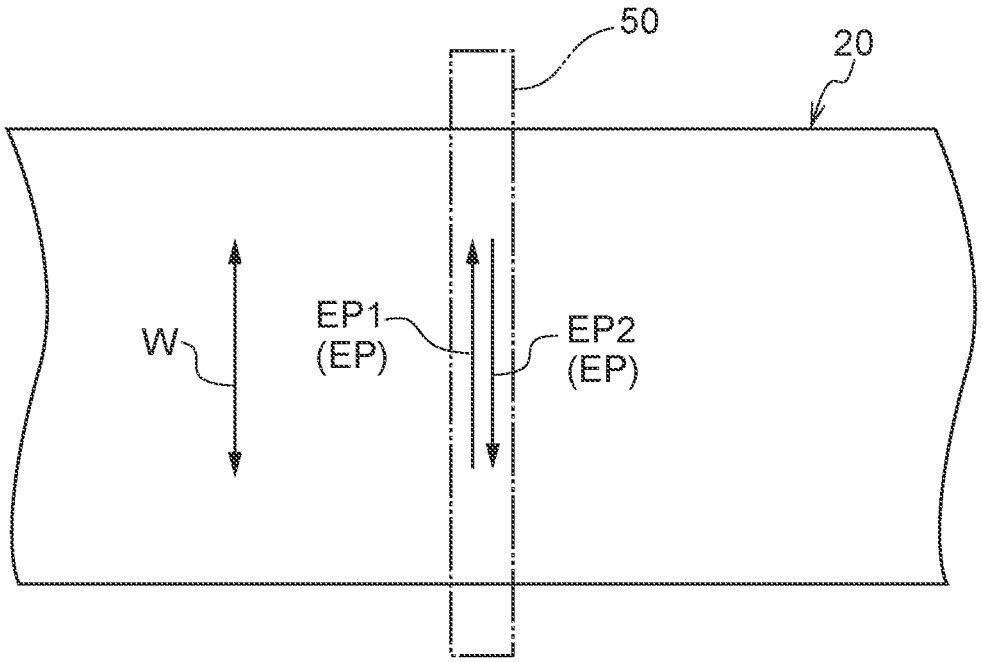
FIG. 3 is a plan view illustrating the cast slab illustrated in FIG. 1 as viewed from the side of a first electromagnetic stirring device.

Specifically, as illustrated in FIG. 3, when the first control section 52 causes alternating current to flow through the electromagnetic coil of the first electromagnetic stirring device 50 in a predetermined direction, electromagnetic force EP (referred to hereafter as "one direction electromagnetic force EP1") is generated to cause the non-solidified portion 20B to flow toward one width direction side of the cast slab 20. When the first control section 52 causes alternating current to flow through the electromagnetic coil of the first electromagnetic stirring device 50 in the opposite direction to the predetermined direction, electromagnetic force EP (referred to hereafter as "other direction electromagnetic force EP2") is generated to cause the non-solidified portion 20B to flow toward the other width direction side of the cast slab 20.

The first control section 52 controls the first electromagnetic stirring device 50 such that the first electromagnetic stirring device 50 intermittently generates the one direction electromagnetic force EP1 and the other direction electromagnetic force EP2. Specifically, the first control section 52 alternately and intermittently applies the electromagnetic coil of the first electromagnetic stirring device 50 with an alternating current to cause the first electromagnetic stirring device 50 to generate the one direction electromagnetic force EP1 and an alternating current to cause the first electromagnetic stirring device 50 to generate the other direction electromagnetic force EP2.

Note that in order to set the flow rate of the non-solidified portion 20B at the solidification interface to at least 5 cm/s, the one direction electromagnetic force EP1 and the other direction electromagnetic force EP2 are preferably alternately imparted to the cast slab, in a range of from 20 seconds to 50 seconds, in consideration of the rate of acceleration, steady speed, rate of deceleration, and so on of the non-solidified portion 20B. The one direction electromagnetic force EP1 and the other direction electromagnetic force EP2 are preferably imparted to the non-solidified portion 20B of the cast slab 20 with an interval of from 1 second to 10 seconds therebetween.

Second Electromagnetic Stirring Device

The second electromagnetic stirring device 60 is a contact-free stirring device that imparts electromagnetic force to the concentrated molten steel that has been pushed back from between the pair of reduction rolls 42 toward the casting mold 16 in order to stir (electromagnetically stir) the concentrated molten steel. Note that the concentrated molten steel refers to molten steel where a concentration of a particular component has increased due to segregation (solidification segregation).

The second electromagnetic stirring device 60 is disposed downstream of the first electromagnetic stirring device 50 in the conveyance direction of the cast slab 20. The second electromagnetic stirring device 60 is also disposed upstream of the pair of reduction rolls 42 in the conveyance direction of the cast slab 20. The second electromagnetic stirring device 60 is disposed opposing the solidified shell 20A at the upper face side of the cast slab 20 as the cast slab 20 passes the horizontal section of the conveyance path 34 where the conveyance path 34 extends substantially in the horizontal direction. The second electromagnetic stirring device 60 may be disposed at the lower side of the cast slab 20.

The second electromagnetic stirring device 60 is configured similarly to the first electromagnetic stirring device 50. A second control section 62 is electrically connected to the second electromagnetic stirring device 60. The second control section 62 is configured similarly to the first control section 52. Thus, the second electromagnetic stirring device 60 alternately generates electromagnetic force in one direction and electromagnetic force in another direction, separated by a predetermined interval.

The one direction electromagnetic force causes the non-solidified portion 20B from which the concentrated molten steel has been expelled to flow toward the one width direction side of the cast slab 20. The other direction electromagnetic force causes the non-solidified portion 20B from which the concentrated molten steel has been expelled to flow toward the other width direction side of the cast slab 20. The second control section 62 applies an alternating current at a frequency F satisfying Equation (1) to the electromagnetic coil of the second electromagnetic stirring device 60. The flow rate of the solidification interface of the non-solidified portion 20B is therefore at least 5 cm/s.

The concentrated molten steel pushed back from between the pair of reduction rolls 42 toward the casting mold 16 accordingly mixes more easily with the molten steel (base molten steel) being conveyed from the casting mold 16 toward the pair of reduction rolls 42.

Note that from the perspective of efficient stirring of the concentrated molten steel that has been pushed back from the pair of reduction rolls 42 toward the casting mold 16, the center of the second electromagnetic stirring device 60 in the conveyance direction of the cast slab 20 is preferably disposed at a position in a range of from 4 m to 8 m upstream from the centers of rotation of the pair of reduction rolls 42 along the conveyance direction of the cast slab 20.

Operation

Explanation follows regarding operation of the present exemplary embodiment, including explanation regarding the continuous casting method (cast slab manufacturing method) according to present exemplary embodiment.

In the continuous casting method according to the present exemplary embodiment, the non-solidified portion 20B in the cast slab 20 conveyed from the casting mold 16 is respectively stirred by the first electromagnetic stirring device 50 and the second electromagnetic stirring device 60.

Next, the cast slab 20 containing the non-solidified portion 20B is rolled by the reduction rolls 42. The concentrated molten steel in the non-solidified portion 20B is thus pushed back from between the pair of reduction rolls 42 toward the casting mold 16.

The concentrated molten steel that has been pushed back from between the pair of reduction rolls 42 toward the casting mold 16 is stirred by the second electromagnetic stirring device 60. This facilitates mixing of the concentrated molten steel that has been pushed back from between the pair of reduction rolls 42 toward the casting mold 16 with the molten steel (base molten steel) that is being conveyed from the casting mold 16 toward the pair of reduction rolls 42. The concentrated molten steel is diluted as a result. The concentrated molten steel is thereby suppressed from remaining as macrosegregation in the thickness direction central portion of the cast slab 20.

The first electromagnetic stirring device 50 is disposed upstream of the pair of reduction rolls 42 in the conveyance direction of the cast slab 20. The first electromagnetic stirring device 50 alternately imparts the cast slab 20 with the one direction electromagnetic force EP1 to cause the non-solidified portion 20B to flow toward the one width direction side of the cast slab at a flow rate of at least 5 cm/s, and the other direction electromagnetic force EP2 to cause the non-solidified portion 20B to flow toward the other width direction side of the cast slab 20 at a flow rate of at least 5 cm/s.

Due to the non-solidified portion flowing toward the one width direction side of the cast slab at a flow rate of at least 5 cm/s under the one direction electromagnetic force EP1, shear force of a predetermined value or greater acts on the tips of the dendrites in the non-solidified portion 20B. Similarly, due to the non-solidified portion 20B flowing toward the other width direction side of the cast slab 20 at a flow rate of at least 5 cm/s under the other direction electromagnetic force EP2, shear force of a predetermined value or greater acts on the tips of the dendrites in the non-solidified portion 20B. This snaps off the tips of the dendrites forming in the surface layer portion of the cast slab 20, facilitating the formation of equiaxed grains.

The first electromagnetic stirring device 50 alternately imparts the cast slab with the one direction electromagnetic force EP1 and the other direction electromagnetic force EP2. Accordingly, in the present exemplary embodiment, the tips of the dendrites in the non-solidified portion 20B can be snapped off even more easily than in cases in which the first electromagnetic stirring device 50 only causes the non-solidified portion 20B to flow toward one width direction side of the cast slab 20.

Snapping off the tips of the dendrites forming in the surface layer portion of the cast slab 20 reduces flow resistance (obstacles) to the concentrated molten steel being pushed back toward the casting mold 16 from between the pair of reduction rolls 42 downstream of the first electromagnetic stirring device 50 in the conveyance direction of the cast slab 20. This makes it easier to push back the concentrated molten steel from between the pair of reduction rolls 42 toward the casting mold 16. The concentrated molten steel is thus suppressed from remaining as macrosegregation in the central portion of the cast slab 20.

Moreover, using the first electromagnetic stirring device 50 to snap off the tips of the dendrites reduces trapping of semi-macrosegregation between the dendrites. Semi-macrosegregation is thus suppressed from remaining at the central portion of the cast slab 20.

In this manner, in the present exemplary embodiment, first, the one direction electromagnetic force EP1 and the other direction electromagnetic force EP2 of the first electromagnetic stirring device 50 are used to stir the non-solidified portion 20B in the surface layer portion of the cast slab 20. Next, the concentrated molten steel in the non-solidified portion 20B that is being pushed back toward the casting mold 16 by the pair of reduction rolls 42 is stirred by the second electromagnetic stirring device 60. Accordingly, the present exemplary embodiment enables macrosegregation and semi-macrosegregation in the cast slab 20 to be reduced.

Note that JP-A No. 2010-179342 discloses a continuous casting apparatus in which a non-solidified portion of a cast slab is electromagnetically stirred by a first electromagnetic stirring device and a second electromagnetic stirring device. In the continuous casting apparatus of JP-A No. 2010-179342, the concentrated molten steel in the non-solidified portion that is pushed back toward a casting mold by a pair of reduction rolls is alternately electromagnetically stirred by the second electromagnetic stirring device. However, the first electromagnetic stirring device that is disposed closer than the second electromagnetic stirring device to the casting mold does not perform alternate electromagnetic stirring, and instead performs electromagnetic stirring in a single regular direction such that the non-solidified portion flows toward one width direction side of the cast slab.

By contrast, in the present exemplary embodiment, the first electromagnetic stirring device 50 that is disposed closer than the second electromagnetic stirring device 60 to the casting mold alternately stirs the non-solidified portion 20B of the cast slab 20 using the one direction electromagnetic force EP1 and other direction electromagnetic force EP2. The present exemplary embodiment is thus more capable of reducing macrosegregation and semi-macrosegregation in the cast slab 20 than the technology disclosed in JP-A No. 2010-179342.

The first electromagnetic stirring device 50 intermittently imparts the non-solidified portion 20B of the cast slab 20 with the one direction electromagnetic force EP1 and the other direction electromagnetic force EP2. Namely, the first electromagnetic stirring device 50 stops imparting the cast slab 20 with the one direction electromagnetic force EP1, and then starts imparting the cast slab 20 with the other direction electromagnetic force EP2 after an interval of a predetermined duration. Similarly, the first electromagnetic stirring device 50 stops imparting the cast slab 20 with the other direction electromagnetic force EP2, and then starts imparting the cast slab 20 with the one direction electromagnetic force EP1 after an interval of a predetermined duration.

Accordingly, for example, the flow rate of the non-solidified portion 20B flowing toward the one width direction side of the cast slab 20 decreases between stopping imparting the one direction electromagnetic force EP1 and starting to impart the other direction electromagnetic force EP2 to the cast slab 20. In this state, the first electromagnetic stirring device 50 starts to impart the cast slab 20 with the other direction electromagnetic force EP2. The direction of flow of the non-solidified portion 20B therefore reverses smoothly, making it easier to cause the non-solidified portion 20B to flow toward the other width direction side of the cast slab 20.

Similarly, when the electromagnetic force imparted to the cast slab 20 is switched from the other direction electromagnetic force EP2 to the one direction electromagnetic force EP1, the direction of flow of the non-solidified portion 20B reverses smoothly, making it easier to cause the non-solidified portion 20B to flow toward the one width direction side of the cast slab 20.

This enables the tips of the dendrites in the non-solidified portion 20B to be snapped off while reducing the power consumption of the first electromagnetic stirring device 50.

As previously described, the positions of the tips of the dendrites, namely the solidification interface of the non-solidified portion 20B, fluctuate according to the thickness of the solidified shell 20A. Moreover, the penetration depth at which the electromagnetic force EP penetrates the cast slab 20 fluctuates according to the frequency of the alternating current applied to the electromagnetic coil of the first electromagnetic stirring device 50.

Accordingly, the first control section 52 applies an alternating current to the electromagnetic coil of the first electromagnetic stirring device 50 at a predetermined frequency determined according to the thickness of the solidified shell 20A. Specifically, an alternating current that satisfies Equation (1) is applied to the electromagnetic coil of the first electromagnetic stirring device 50. According to Equation (1), the frequency F of the alternating current applied to the electromagnetic coil of the first electromagnetic stirring device 50 is lowered as the thickness D of the solidified shell 20A increases. Conversely, according to Equation (1), the frequency F of the alternating current applied to the electromagnetic coil of the first electromagnetic stirring device 50 is raised as the thickness D of the solidified shell 20A decreases.

Accordingly, the one direction electromagnetic force EP1 and the other direction electromagnetic force EP2 can be caused to act on the tips of the dendrites in the vicinity of the solidification interface of the non-solidified portion 20B, regardless of the thickness of the solidified shell 20A. This enables the tips of the dendrites to be snapped off efficiently.

Similarly to the first electromagnetic stirring device 50, the second electromagnetic stirring device 60 alternately, and also intermittently imparts the non-solidified portion 20B of the cast slab 20 with the one direction electromagnetic force and the other direction electromagnetic force. This enables the concentrated molten steel pushed back from between the pair of reduction rolls 42 toward the casting mold 16 to be efficiently mixed with the molten steel being conveyed from between the pair of reduction rolls 42 toward the casting mold 16. This reduces the macrosegregation remaining at the central portion of the cast slab 20.

MODIFIED EXAMPLES

Explanation follows regarding modified examples of the present exemplary embodiment.

The first electromagnetic stirring device 50 of the exemplary embodiment described above alternately and also intermittently imparts the cast slab 20 with the one direction electromagnetic force EP1 and the other direction electromagnetic force EP2. However, the first electromagnetic stirring device 50 may alternately and continuously impart the cast slab 20 with the one direction electromagnetic force EP1 and the other direction electromagnetic force EP2.

Similarly to the first electromagnetic stirring device 50, the second electromagnetic stirring device 60 of the exemplary embodiment described above alternately and also intermittently imparts the cast slab 20 with the one direction electromagnetic force and the other direction electromagnetic force. However, the second electromagnetic stirring device 60 may alternately and continuously impart the cast slab 20 with either the one direction electromagnetic force or the second direction electromagnetic force. Alternatively, the second electromagnetic stirring device 60 may either continuously or intermittently impart the cast slab 20 with just one out of the one direction electromagnetic force or the other direction electromagnetic force.

The first control section 52 of the exemplary embodiment described above imparts an alternating current that satisfies Equation (1) to the electromagnetic coil of the first electromagnetic stirring device 50. However, the frequency of the alternating current imparted to the electromagnetic coil of the first electromagnetic stirring device 50 may be determined without employing Equation (1).

The placement of the first electromagnetic stirring device 50 and the second electromagnetic stirring device 60 relative to the conveyance path 34 may be modified as appropriate. The thickness and conveyance speed of the cast slab 20 may likewise by the modified as appropriate.

Continuous Casting Testing

Explanation follows regarding testing of the continuous casting.

For this continuous casting testing, plural cast slabs of Examples 1 to 5 were continuously cast using the continuous casting apparatus 10 illustrated in FIG. 1, and each of these cast slabs was internally checked for the presence or absence of semi-macrosegregation and macrosegregation. Plural cast slabs of Comparative Examples 1 to 3 were also continuously cast, and each of these cast slabs was also internally checked for the presence or absence of semi-macrosegregation and macrosegregation.

Molten Steel

The composition of the molten steel as percentage by mass was as follows: C: 0.05% to 0.15%, Si: 0.1% to 0.4%, Mn: 0.8% to 1.5%, P: 0.02% or lower, S: 0.008% or lower, with the remainder being Fe and impurities.

Casting Mold

A water-cooled copper casting mold was employed as the casting mold 16. Respective dimensions of the casting mold 16 are as given in Table 1 below.

TABLE 1

| | Cross-section profile | Axial direction length (mm) | Thickness (mm) | Width (mm) |
|---|---|---|---|---|
| Casting mold | Rectangular | 800 | 250-300 | 2300 |

Conveyance Device

The casting speed of the cast slab by the conveyance device 30 was set from 0.7 m/min to 1.1 m/min. The specific water ratio of the cooling devices (secondary cooling devices) of the conveyance device 30 was set to 0.5 l/kg steel to 1.2 l/kg steel. Accordingly, the center solid phase ratio R at the thickness direction center of the cast slab rolled by the pair of reduction rolls 42 was set in a range of from 0.01 to 0.2 (see FIG. 4).

First Electromagnetic Stirring Device

The first electromagnetic stirring device 50 was disposed 9 m downstream from the meniscus M in the casting mold 16 along the conveyance direction of the cast slab 20.

FIG. 4 gives thicknesses of the solidified shells of the cast slabs as they pass the first electromagnetic stirring device 50. Note that the thickness of the solidified shell refers to the thickness of the solidified shell on the first electromagnetic stirring device 50 side of the cast slab. The thickness of the solidified shell is computed using 2-dimensional solidification analysis.

FIG. 4 also gives the stirring methods of the non-solidified portions of the cast slabs by the first electromagnetic stirring device 50. Here, alternate stirring refers to alternately and also intermittently imparting the one direction electromagnetic force and the other direction electromagnetic force to the non-solidified portion of the cast slab. In this continuous casting testing, the one direction electromagnetic force and the other direction electromagnetic force were alternately imparted to the non-solidified portion of the cast slab for 30 seconds at a time. The one direction electromagnetic force and the other direction electromagnetic force were imparted to the non-solidified portion of the cast slab separated by 5 second intervals.

Single direction stirring refers to continuously imparting either the one direction electromagnetic force or the other direction electromagnetic force to the non-solidified portion of the cast slab.

FIG. 4 also gives frequencies of the alternating current (three-phase alternating current) applied to the electromagnetic coil of the first electromagnetic stirring device 50. Note that the alternating current applied to the electromagnetic coil of the first electromagnetic stirring device 50 was set to 600 A. FIG. 4 also gives the flow rate of the non-solidified portion of the cast slab at the solidification interface.

Note that the flow rate of the non-solidified portion at the solidification interface was converted and estimated from Equation (a) and Equation (b) below using an Mn segregation ratio $C_{Mn}$. A solidification rate V was computed using a solidification calculation.

$$U=7500\times V\times Sh/(1-Sh) \quad \text{(a)}$$

$$Sh=(C_{Mn}-1)/(K_0-1) \quad \text{(b)}$$

Wherein U is the flow rate of molten steel (cm/s), V is the solidification rate (cm/s), and $K_0$ is an equilibrium partition coefficient of Mn (=0.77).

Second Electromagnetic Stirring Device

The second electromagnetic stirring device 60 was disposed 14.6 m downstream of the meniscus M in the casting mold 16 along the conveyance direction of the cast slab 20.

The stirring method of the non-solidified portion of the cast slab by the second electromagnetic stirring device 60 was alternate stirring, similarly to the first electromagnetic stirring device 50. Likewise, similarly to the first electromagnetic stirring device 50, the second electromagnetic stirring device 60 alternately imparted the non-solidified portion of the cast slab with the one direction electromagnetic force and the other direction electromagnetic force for 30 seconds at a time. The one direction electromagnetic force and the other direction electromagnetic force were imparted to the non-solidified portion of the cast slab separated by 5 second intervals.

The alternating current (three-phase alternating current) applied to the electromagnetic coil of the second electromagnetic stirring device 60 was set to 900 A. The frequency of the alternating current applied to the electromagnetic coil of the second electromagnetic stirring device 60 was set to 1.5 Hz.

Pressing Device

The pair of reduction rolls 42 were disposed 21.2 m downstream from the meniscus M in the casting mold 16 along the conveyance direction of the cast slab. The reduction roll 42 disposed at the upper side of the cast slab was pressed by a non-illustrated hydraulic cylinder to roll the cast slab where the center solid phase ratio at the thickness direction and width direction center of the cast slab was in a range of from 0.01 to 0.2 (see FIG. 4).

Note that the maximum rolling force (maximum output) of the reduction rolls 42 was 600 tonf (5.88 MN). Moreover, the reduction rolling amount of the cast slab by the reduction rolls 42 was set to from 25 mm to 35 mm (see FIG. 4). The thickness T of the cast slab as given in FIG. 4 refers to the thickness of the cast slab prior to being rolled by the reduction rolls 42.

Cast Slab Evaluation Method

The cast slabs were evaluated by visually checking the macro structure of samples cut from a lateral cross-section of the cast slabs of Examples 1 to 5 and Comparative Examples 1 to 3 to check for the presence or absence of semi-macrosegregation and macrosegregation. The sample failed (FAIL) in cases in which at least one out of semi-macrosegregation or macrosegregation was present, and passed (PASS) in cases in which neither semi-macrosegregation nor macrosegregation were present.

Mapping analysis was performed using an Electron Probe Micro Analyzer (EPMA) in the thickness direction of the cast slabs of Examples 1 to 5 and Comparative Examples 1 to 3 in order to create a Mn concentration distribution in the thickness direction of the corresponding cast slab. The Mn concentration distribution of each of the analyzed cast slabs was divided by the Mn concentration in molten steel sampled from the tundish 12 to create the Mn segregation ratio $C_{Mn}$ distribution in the thickness direction of the cast slab.

The Mn segregation ratio $C_{Mn}$ distribution in the thickness direction of the respective cast slabs after being rolled by the reduction rolls 42 was used to find a minimum value of the Mn segregation ratio at a center line region, a region L1, and a region L2 along the thickness direction of the cast slab (see FIG. 4).

The center line region referred to here is a region extending 10 mm toward each side from the thickness direction center of the cast slab (a region covering a total of 20 mm). The region L1 (mm) is a region stirred by the first electromagnetic stirring device 50, and refers to a region in the range expressed by Equation (3) below. The region L2 (mm) is a region stirred by the second electromagnetic stirring device 60, and refers to a region in the range expressed by Equation (4) below.

Equations (3) and (4)

$$\frac{66}{\sqrt{V_C}} \leq L1 \leq \frac{78}{\sqrt{V_C}} \quad (3)$$

$$\frac{85}{\sqrt{V_C}} \leq L2 \leq \frac{101}{\sqrt{V_C}} \quad (4)$$

wherein $V_C$ is the conveyance speed (m/min).

Note that Equation (3) and Equation (4) can be converted to Equation (5) and Equation (6) below by employing a constant B1 or a constant B2.

Equations (5) and (6)

$$L1 = \frac{B1}{\sqrt{V_C}} \quad (5)$$

$$L2 = \frac{B2}{\sqrt{V_C}} \quad (6)$$

wherein B1 is a constant (66≤B1≤78), B2 is a constant (85≤B2≤101), and $V_C$ is the conveyance speed (m/min).

Figure 5:
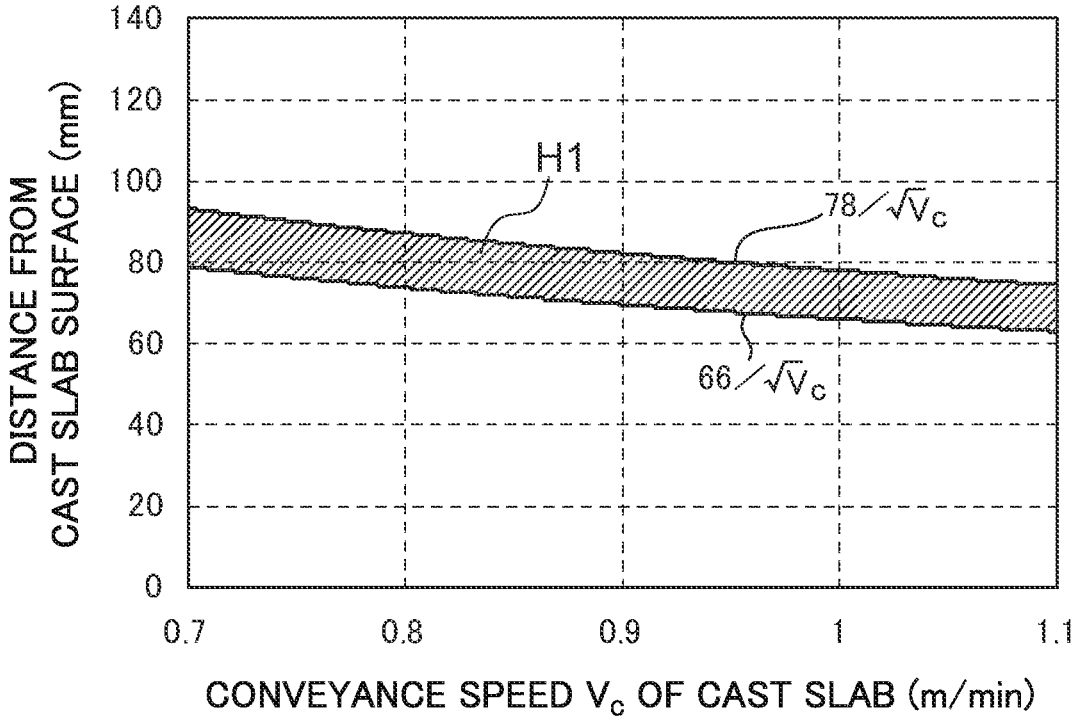
FIG. 5 is a graph illustrating a relationship between a conveyance speed $V_C$ of a cast slab and distance from the surface of the cast slab.
Figure 6:
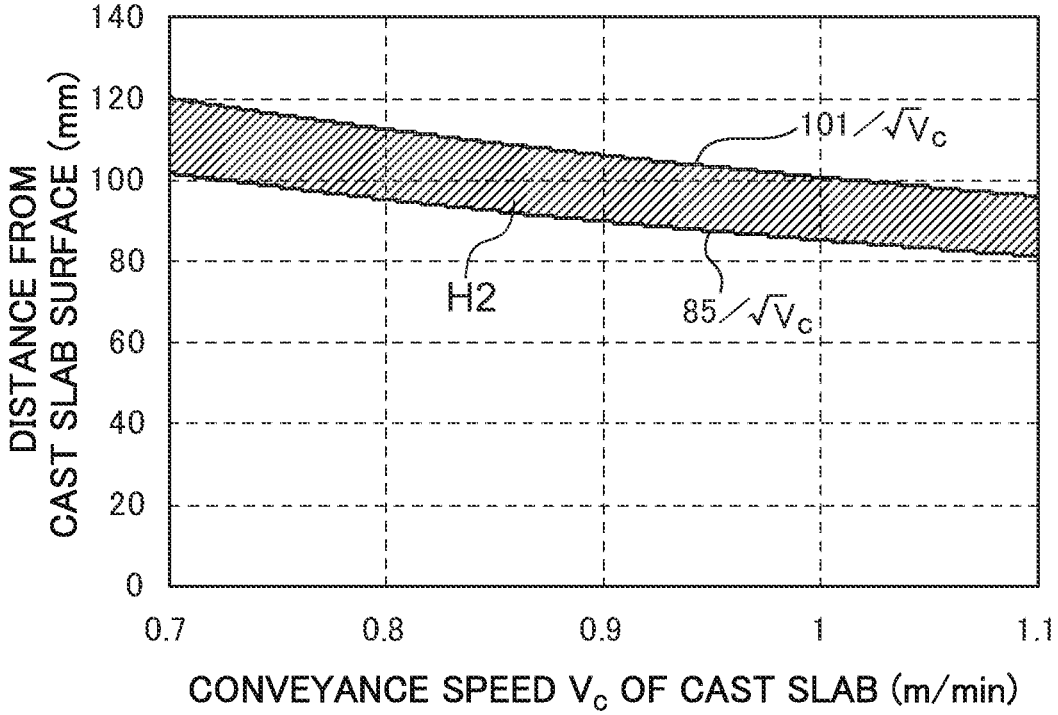
FIG. 6 is a graph illustrating a relationship between a conveyance speed $V_C$ of a cast slab and distance from the surface of the cast slab.

Further explanation follows regarding the regions L1, L2. FIG. 5 and FIG. 6 illustrate relationships between the conveyance speed $V_C$ (casting speed) of a cast slab and the distance from the surface of the cast slab. The regions H1, H2 illustrated in FIG. 5 and FIG. 6 are regions where the flow rate of the non-solidified portion at least 5 cm/s. Note that the graphs illustrated in FIG. 5 and FIG. 6 are obtained by solidification analysis of the cast slab.

The flow rate of the non-solidified portion of the cast slab is at least 5 cm/s at the two regions that are the region H1 illustrated in FIG. 5 and the region H2 illustrated in FIG. 6. Based on these two regions H1, H2, the region H1 on the surface side (first electromagnetic stirring device 50 side) of the cast slab is estimated as the region L1 stirred by the first electromagnetic stirring device 50, and the region H2 toward the thickness direction center of the cast slab 20 is estimated as the region L2 stirred by the second electromagnetic stirring device 60.

Evaluation Results

FIG. 4 gives evaluation results for the cast slabs according to Examples 1 to 5 and Comparative Examples 1 to 3.

EXAMPLES

Macrosegregation and semi-macrosegregation were not confirmed in any of Example 1 to Example 5. In Example 1 to Example 5, the non-solidified portion of the cast slab was stirred by alternate stirring using the first electromagnetic stirring device 50, and the flow rate of the non-solidified portion at the solidification interface was set to at least 5.0 cm/s. This is thought to have efficiently snapped off the tips of the dendrites in the non-solidified portion, and generated equiaxed grains.

Moreover, in Example 1 to Example 5, the minimum values of the Mn segregation ratio at the center line regions of the cast slabs were from 0.92 to 0.95. The minimum values of the Mn segregation ratio at the regions L1 of the cast slabs were from 0.95 to 0.98. The minimum values of the Mn segregation ratio at the regions L2 of the cast slabs were from 0.96 to 0.97.

Figure 7:
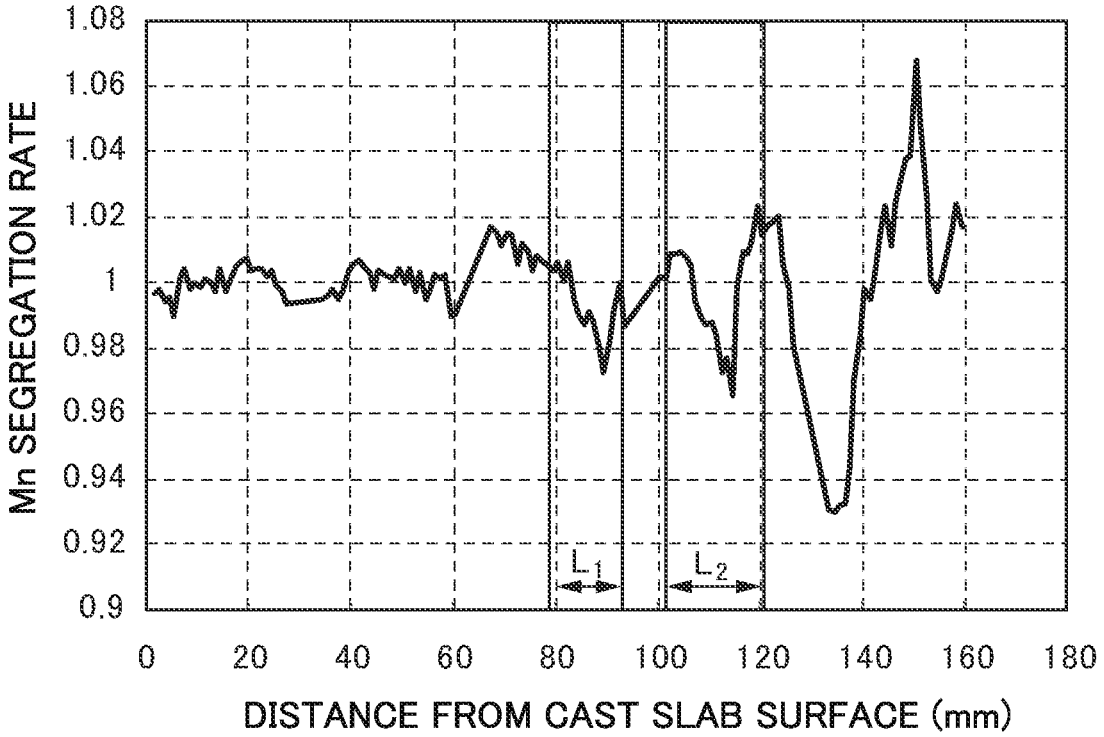
FIG. 7 is a graph illustrating distribution of Mn segregation ratios in the thickness direction of a cast slab according to an Example 2 that has been continuously cast in continuous casting testing.

FIG. 7 illustrates the Mn segregation ratio distribution in the thickness direction of the cast slab according to Example 2. The presence or absence of negative segregation bands at the center line region and regions L1, L2 can be confirmed using the Mn segregation ratio distribution illustrated in FIG. 7.

Negative segregation bands refer to regions where the Mn segregation ratio is less than 1.0 that continue for 5 mm or longer in the thickness direction of the cast slab. Note that a negative segregation band at the center line region is an example of a center line negative segregation band. A negative segregation band at the region L1 is an example of a surface side negative segregation band. A negative segregation band at the region L2 is an example of an intermediate negative segregation band.

In Example 2, the reduction rolling amount by the reduction rolls 42 is 30 mm. The thickness direction center of the cast slab is therefore 135 mm from the surface of the cast slab. The center line region of the cast slab is a region in a range spanning from 125 mm to 145 mm from the surface of the cast slab. The conveyance speed $V_C$ of the cast slab of Example 2 is set to 0.7 m/min. Based on Equation (3), the regions L1, L2 of Example 2 are therefore as follows.

$$78.9 \text{ mm} \leq L1 \leq 93.2 \text{ mm}$$

$$101.6 \text{ mm} \leq L2 \leq 102.7 \text{ mm}$$

As illustrated in FIG. 7, at the center line region, a region where the Mn segregation ratio is less than 1.0 continues for 17 mm in the thickness direction of the cast slab. At the region L1, a region where the Mn segregation ratio is less than 1.0 continues for 10 mm in the thickness direction of the cast slab. At the region L2, a region where the Mn segregation ratio is less than 1.0 continues for 8 mm in the thickness direction of the cast slab. The generation of negative segregation bands at each of the center line region and the regions L1, L2 along the thickness direction of the cast slab can thus be confirmed.

Comparative Examples

As illustrated in FIG. 4, although macrosegregation was not confirmed in Comparative Example 1, semi-macrosegregation was confirmed. In Comparative Example 1, single direction stirring was performed as the stirring method of the non-solidified portion of the cast slab by the first electromagnetic stirring device 50. It is conceivable that the tips of the dendrites in the non-solidified portion were not sufficiently snapped off as a result.

Next, in Comparative Example 2, both macrosegregation and semi-macrosegregation were confirmed. In Comparative Example 2, the frequency of the alternating current applied to the electromagnetic coil of the first electromagnetic stirring device 50 was set to 1 Hz. It is conceivable that the electromagnetic force of the first electromagnetic stirring device 50 (one direction electromagnetic force and other direction electromagnetic force) acted at a position deeper than the solidification interface of the non-solidified portion. It is conceivable that the flow rate at the solidification interface was therefore slow, at only 3.5 cm/s, and the tips of the dendrites in the non-solidified portion were not sufficiently snapped off as a result.

Next, in Comparative Example 3, although macrosegregation was not confirmed, semi-macrosegregation was confirmed. In Comparative Example 3, the frequency of the alternating current applied to the electromagnetic coil of the first electromagnetic stirring device was set to 4 Hz. It is conceivable that the electromagnetic force of the first electromagnetic stirring device 50 (one direction electromagnetic force and other direction electromagnetic force) acted at a position shallower than the solidification interface of the non-solidified portion. It is conceivable that the flow rate at the solidification interface was therefore slow, at only 4.5 cm/s, and the tips of the dendrites in the non-solidified portion were not sufficiently snapped off as a result.

Note that in cases in which the thickness of the solidified shell is 68 mm as in Comparative Example 2 and Comparative Example 3, in order to set the flow rate at the solidification interface of the non-solidified portion to at least 5 cm/s, it is necessary to apply an alternating current with a frequency in a range of from 1.2 Hz to 2.4 Hz to the electromagnetic coil of the first electromagnetic stirring device.

Summary of Evaluation Results

It can be seen from the evaluation results described above that high quality cast slabs in which macrosegregation and semi-macrosegregation are not present can be obtained using Examples 1 to 5.

Explanation has been given regarding an exemplary embodiment of the technology disclosed herein. However, the technology disclosed herein is not limited to such an exemplary embodiment, and obviously the exemplary embodiment and various modified examples may be combined as appropriate, and various modifications may be implemented in a range not departing from the spirit of the technology disclosed herein.

The disclosure of Japanese Patent Application No. 2018-042106, filed on Mar. 8, 2018, is incorporated in its entirety by reference herein.

All cited documents, patent applications, and technical standards mentioned in the present specification are incorporated by reference in the present specification to the same extent as if each individual cited document, patent application, or technical standard was specifically and individually indicated to be incorporated by reference.

The invention claimed is:

1. A continuous casting method, comprising:

conveying a cast slab from a casting mold;

stirring a non-solidified portion in the cast slab with a first electromagnetic stirring device;

stirring the non-solidified portion with a second electromagnetic stirring device disposed downstream of the first electromagnetic stirring device in a conveyance direction of the cast slab; and subsequently, rolling the cast slab with a reduction roll, wherein:

the first electromagnetic stirring device alternately imparts the cast slab with electromagnetic force in one direction to cause the non-solidified portion to flow toward one width direction side of the cast slab at a flow rate of at least 5 cm/s, and with electromagnetic force in another direction to cause the non-solidified portion to flow toward another width direction side of the cast slab at a flow rate of at least 5 cm/s, and wherein:

the cast slab includes a solidified shell enclosing the non-solidified portion; and an alternating current satisfying the following Equation (1) is applied to the first electromagnetic stirring device so as to cause the first electromagnetic stirring device to generate electromagnetic force in the one direction and electromagnetic force in the other direction:

[Equation (1)]

$$\frac{80}{D} \leq F \leq \frac{160}{D} \quad (1)$$

wherein F is a frequency of the alternating current (Hz) and D is a thickness (mm) of the solidified shell at a side of the first electromagnetic stirring device.

2. The continuous casting method of claim 1, wherein the first electromagnetic stirring device intermittently imparts the cast slab with electromagnetic force in the one direction and electromagnetic force in the other direction.

3. The continuous casting method of claim 1, wherein the electromagnetic force in the one direction and the electromagnetic force in the other direction each produce a flow rate of at least 5 cm/s at a solidification interface of the non-solidified portion.

4. The continuous casting method of claim 1, wherein the second electromagnetic stirring device stirs molten steel in the non-solidified portion that has been pushed back toward the casting mold by the reduction roll.

5. The continuous casting method of claim 1, wherein the second electromagnetic stirring device alternately imparts the cast slab with electromagnetic force in the one direction to cause the non-solidified portion to flow toward the one width direction side of the cast slab and with electromagnetic force in the other direction to cause the non-solidified portion to flow toward the other width direction side of the cast slab.

6. The continuous casting method of claim 1, wherein:

a thickness of the cast slab is in a range of from 250 mm to 300 mm;

a conveyance speed of the cast slab is in a range of from 0.7 m/min to 1.1 m/min; and the first electromagnetic stirring device is disposed in a range of from 6 m to 10 m downstream of a meniscus in the casting mold along the conveyance direction of the cast slab.

* * * * *